US008201794B1

(12) United States Patent
Pesola

(10) Patent No.: US 8,201,794 B1
(45) Date of Patent: Jun. 19, 2012

(54) PORTABLE BEVERAGE CONTAINER STAND

(75) Inventor: Jason Pesola, Yorkville, IL (US)

(73) Assignee: Backyard Marketing Systems, Inc., Yorkville, IL (US)

( * ) Notice: Subject to any disclaimer, the term of this patent is extended or adjusted under 35 U.S.C. 154(b) by 207 days.

(21) Appl. No.: 12/661,645

(22) Filed: Mar. 22, 2010

(51) Int. Cl.
*A47K 1/09* (2006.01)

(52) U.S. Cl. ..... 248/311.2; 248/312.1; 248/530

(58) Field of Classification Search ..... 248/311.2, 248/312.1, 309.1, 146, 346.11, 314, 315, 248/530, 545; 42/90, 106; 220/480; 224/148.1, 224/148.4
See application file for complete search history.

(56) References Cited

U.S. PATENT DOCUMENTS

| | | | | |
|---|---|---|---|---|
| 4,096,951 | A * | 6/1978 | Menssen | 211/207 |
| 4,334,661 | A | 6/1982 | Pitt | |
| 5,022,626 | A * | 6/1991 | Nozel et al. | 248/311.2 |
| 5,037,162 | A * | 8/1991 | Ransom | 312/236 |
| 5,294,083 | A | 3/1994 | Roth | |
| D366,600 | S | 1/1996 | Laskowski et al. | |
| 5,570,863 | A | 11/1996 | Cooper | |
| 5,713,546 | A | 2/1998 | Auspos | |
| 5,823,496 | A | 10/1998 | Foley et al. | |
| 6,575,417 | B1 | 6/2003 | Krommenakker | |
| 6,945,502 | B2 | 9/2005 | Restifo | |
| D527,231 | S * | 8/2006 | Perotti et al. | D7/707 |
| 7,207,450 | B1 * | 4/2007 | Franklin et al. | 211/205 |
| D587,541 | S * | 3/2009 | Klump | D7/701 |
| D618,074 | S * | 6/2010 | Paetsch | D7/701 |
| 2009/0127420 | A1 * | 5/2009 | Skaggs | 248/313 |

* cited by examiner

*Primary Examiner* — Terrell McKinnon
*Assistant Examiner* — Steven Marsh
(74) *Attorney, Agent, or Firm* — John C. Shepard; Charles F. Lind

(57) ABSTRACT

A portable beverage container stand includes an elongated pointed shaft, a flat cage plate fixed to one end of the shaft and extending laterally outward, a plurality of holes in the cage plate configured to receive beverage containers, a flat shelf plate below the cage plate fixed to the shaft and extending laterally to support containers placed in the cage plate holes, and a push member adjacent the shaft bottom for applying foot pressure for inserting the shaft into the ground. Alternatively, the shaft may also be mounted on a base component having a rectangular bottom frame, with an upwardly extending bridge and brace projected therefrom, with holes therein adapted to cooperatively receive and contain the shaft therein.

5 Claims, 2 Drawing Sheets

PORTABLE BEVERAGE CONTAINER STAND

BACKGROUND OF THE INVENTION

1. Technical Field

The present invention relates to a portable beverage container stand and, more particularly, to a portable beverage container stand that can hold a beverage container as well as a variety of other objects, with stability and on soft or hard surfaces.

2. Background Art

There are many types of holders and stands described in prior art patents that can be pushed into the ground and are capable of supporting a beverage container.

Pitt U.S. Pat. No. 4,334,661 shows a pointed stake having a ring laterally fixed thereto at its side and a laterally extending foot fixed to the stake below and aligned with the ring, operable to support a drink container on the foot and held within the ring.

Roth U.S. Pat. No. 5,294,083 shows a drink holder with a pointed stake, a cylindrical cup-shaped body on top of the stake, and a hook on the side of the stake to hold down the edge of a beach blanket.

Laskowski et al. U.S. Design Pat. No. 366,600 shows a beverage container holder with a pointed spike having an attached container holding cup, and having a hook for holding down a blanket or towel.

Cooper U.S. Pat. No. 5,570,863 shows a drink holder having a pointed lower end that can be inserted into the ground and an upper spiral end for holding a container.

Auspos U.S. Pat. No. 5,713,546 shows a folding tray and beverage container holder pivoted off of a stake, for support of the container bottom.

Foley et al. U.S. Pat. No. 5,823,496 shows an outdoor beverage holder with one or more cup holders pivotally mounted to the side of a pointed support member, with an axial bore configured to hold a fishing pole.

Krommenakker U.S. Pat. No. 6,575,417 shows a beverage container holding device having a cup-shaped body coupled to one end of a support with the other end being inserted into the ground along with an attached anchor member spaced from the support.

Restifo U.S. Pat. No. 6,945,502 shows a portable stand supported by one or two legs, with a cross member having multiple recesses or receptacles for holding parts, objects and sports-related equipment.

While these prior art devices are sufficient for their intended function, other constructions may provide features that are more desirable to a user.

BRIEF SUMMARY OF THE INVENTION

The present invention proposes to reduce or overcome one or more of the problems or shortcomings the above constructions have, and further to provide a more useful and highly accepted improved beverage stand.

A basic object of this invention is to provide a beverage container stand that is portable, that can be conveniently stored and easily assembled and/or disassembled, is durable and sturdy, and that can be used on either soft surfaces, such as on grass, dirt, or the like and/or on hard surfaces, such as paved patios, driveways or parking lots, or the like.

Another object of this invention is to provide a beverage container stand that can securely hold a wide variety of beverage containers including glasses, bottles, cans, cups, mugs, juice boxes or the like, even with or without surrounding insulating coozies.

Yet another object of the present invention is to provide a beverage container stand that has a built-in bottle opener for conveniently removing bottle caps.

An additional object of the invention is to provide a beverage container stand that can hold game equipment, scorecards, pencils, food, keys, wallets, handbags and other common user paraphernalia.

An exemplary inventive beverage container stand can utilize a beverage holding laterally extending flat shelf plate fixed to one end of a shaft, and a cage plate fixed to the shaft above the shelf plate and having several holes configured to receive and laterally contain beverage containers supported on the underlying shelf plate.

The preferred shaft is elongated, with a pointed lower end suited in one mode of use to be forced into the ground for stably mounting the shaft. A toe push plate can be fixed adjacent the lower shaft end for applying foot pressure when forcing the shaft into the ground. Interestingly, the toe push plate might be formed from the scrap material piece removed when forming a cage plate hole.

Additionally, the stand can be used on a hard surface not suited to have the shaft forced into it by providing a secondary frame that can rest on the hard surface and present vertically separated and laterally extended upper and lower support structures, with aligned holes adapted to receive and contain the lower end of the shaft, for holding the stand in an upright position.

The invention also might include the formation of tabs and tab holes for retaining objects on or hanging objects from the cage plate and shelf plate, or for forming easily accessible bottle openers integrally of the stand.

BRIEF DESCRIPTION OF THE SUBMITTED DRAWINGS

The details of construction and operation of the invention are more fully described with reference to the accompanying drawings which form a part hereof and in which like reference numerals refer to like parts throughout.

The above figures illustrate a preferred embodiment of the present invention. However, details with respect to the number, position, relationship, and dimensions of the parts can be varied by those skilled in the art. Accordingly, the specific embodiment is to be considered as an exemplification and the principles of the invention, so that the invention should not be limited thereto but only by the following claims.

DETAILED DESCRIPTION OF THE PREFERRED EMBODIMENTS

The submitted drawings illustrate a portable stand, generally designated 20, for holding beverage containers such as glasses, cans, bottles, cups, and to do so while retaining the container vertically upright. The stand 20 includes a holder, generally designated 22, and an optional stand, generally designated 24.

Figure 1:
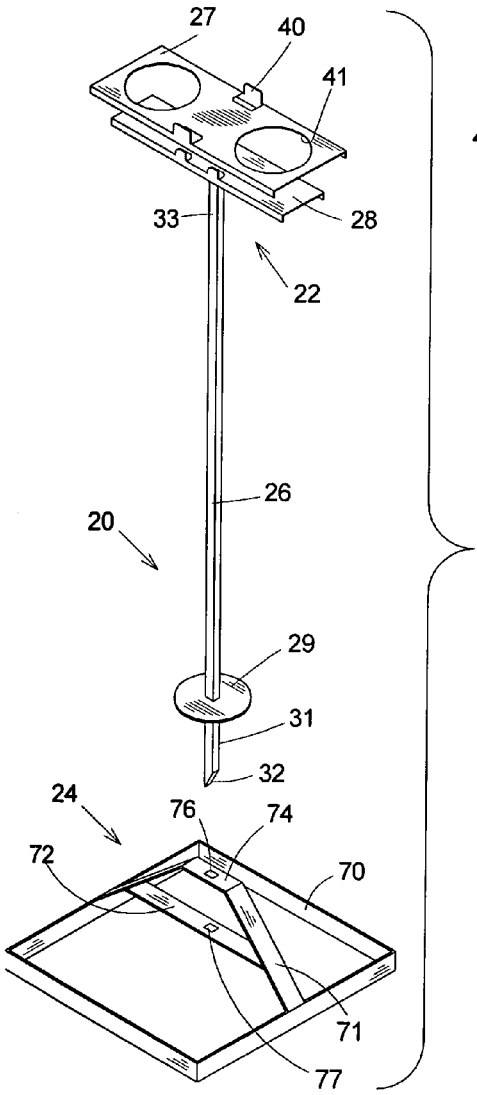
FIG. 1 is an exploded isometric view of a portable beverage container holder and an optional base for holding the stand in accordance with the present invention.
Figure 2:
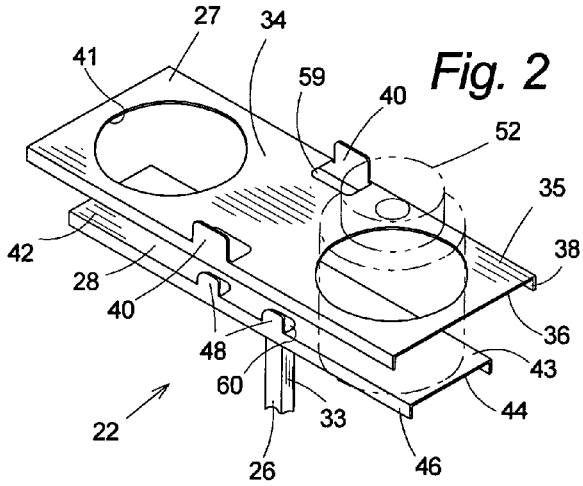
FIG. 2 is an enlarged, fragmentary, isometric view of the top of the portable beverage holder shown in FIG. 1.
Figure 3:
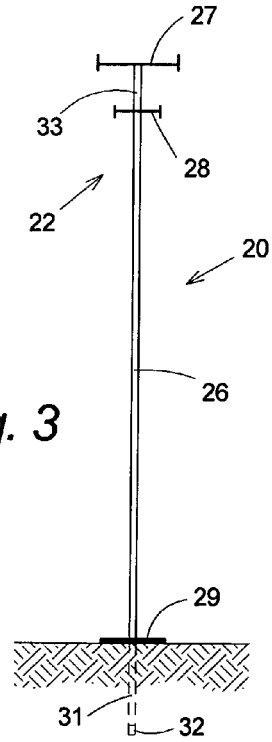
FIG. 3 is a side elevational view of the portable beverage holder of FIG. 1 with the lower end of the holder shaft shown inserted into the ground.
Figure 4:
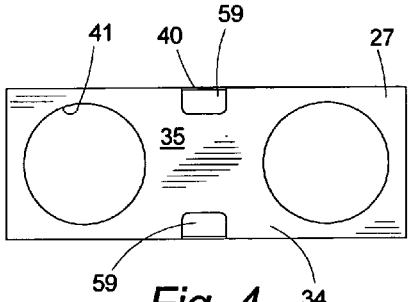
FIG. 4 is an enlarged top plan view of the upper cage plate used in the portable beverage holder shown in FIGS. 1 and 2.
Figure 5:
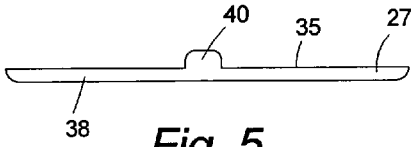
FIG. 5 is a side elevational view of the upper cage plate shown in FIG. 4.
Figure 6:
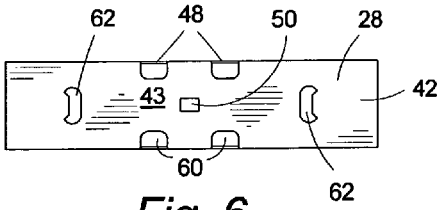
FIG. 6 is an enlarged top plan view of the lower shelf plate of the portable beverage holder shown in FIGS. 1 and 3.
Figure 7:
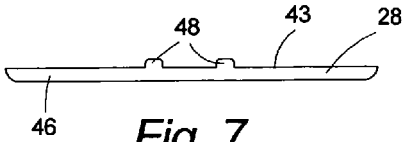
FIG. 7 is an enlarged side elevational view of the lower shelf plate shown in FIG. 6.

As seen in FIGS. 1-3, the holder 22 includes an elongated pole or shaft 26, a relatively thin, rectangular upper stabilizer or cage plate 27, a relatively thin, rectangular lower shelf plate 28, and a flat, circular step or toe push plate 29 near the shaft bottom. Each of these components can be formed of steel or like material.

The cage plate 27 is centered and fixed to the top portion 33 of the shaft 26 and extends laterally outward from opposite sides of the shaft 26. The cage plate 27 includes a substantially flat horizontal wall 34 with top and bottom planar surfaces 35 and 36, respectively, short side flanges 38 for structural rigidity extending downward from the opposed edges of the wall, and upright tabs 40 extending vertically.

A pair of holes 41 defined on either side of the shaft 26 are formed in the cage plate, sized to receive beverage containers therein. To accommodate cans or bottles of soda or beer, with or without coozies, the diameter of the hole 41 should be about 3½ inches, although the diameter may be adjusted according to the application.

The shelf plate 28 is fixed to the shaft 26 below the cage plate 27 and extends laterally outward from opposite sides of the shaft 26 so as to be disposed below the cage plate holes 41. The shelf plate 28 includes a substantially flat horizontal wall 42 with top and bottom planar surfaces 43 and 44, short flanges 46 for structural rigidity extending downward from the opposed edges of the wall, and upright tabs 48 extended vertically above the plane of the wall 42. A hole 50 is formed in the center of the shelf plate 28 corresponding to the cross-sectional size of the shaft 26, such that the shelf plate 28 can be slid onto the shaft 26 from one end and be fixed in place thereon, such as by being welded thereto. The similar rectangular cross sections of the shaft 26 and the hole 50 facilitate accurate angular alignment of the shelf plate 28 relative to the cage plate 27 during holder assembly.

The elongated shaft 26 has a distal end portion 31 including a pointed or beveled tip 32 for facilitating manual insertion of the shaft 26 into the ground. An opposite end portion 33 extends above the ground when the shaft 26 is vertically upright. As disclosed, the shaft 26 has a rectangular cross section and is about 3 feet long, but may have any other suitable shape and or desired length.

When the holder 22 is to be used on soft surfaces, such as bare ground, dirt, grass, sand and the like, the lower end 31 of the holder pole 26 typically can be easily pushed into the ground by using the toe push plate 29 as seen in FIG. 3.

Figure 9:
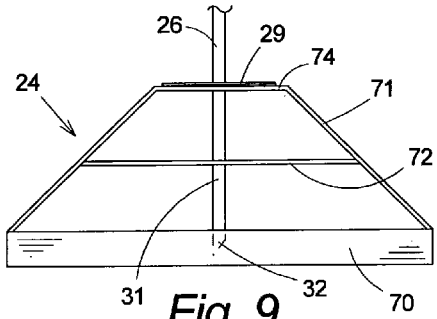
FIG. 9 is an enlarged side elevational view of the base of FIG. 8 with the lower end of the holder shaft shown inserted upright therein; and, FIG. 10 is an enlarged top plan view of the upper cage shown in FIGS. 1, 2, 3, 4 and 5, prior to it being fully formed.

When the holder 22 is to be used on hard surfaces, such as concrete, asphalt, wood and the like, an optional base 24 as disclosed in this invention will be employed to hold the lower end 31 of the holder pole 26 as seen in FIG. 9.

When a container 52, seen in phantom in FIG. 2 with a surrounding insulating coozie (not numbered), is inserted into the cage plate hole 41, the cage plate limits lateral movement of the container 52 while the shelf plate 28 supports the bottom of the container 52 and limits downward movement. The shelf plate 28 can be spaced below the cage plate 27 a distance selected to prevent a typical beverage container from tipping over or from passing completely through the cage hole 41, such as generally about 2 to 3 inches.

The toe push 29 is fixed to the shaft 26 between the shaft distal tip 32 and the shelf plate 28 and is spaced therefrom. The toe push 29 extends radially outward from the shaft 26 to enable a user's foot to engage and apply axial pressure to the shaft to push the holder 22 into the ground. Further, it also might be beneficial when removing the shaft from the ground to position a tool or even the user's foot against the underside of the push plate 29. To provide sufficient support for the shaft 26 when the shaft 26 is inserted into the ground, the circular toe push 26 should be located about 5 inches from the bottom tip 32 of the shaft 26. As the toe push plate 26 butts against the top of the base 24 when the shaft is held in the base 24, the height of the base as disclosed herein should exceed the projected terminal distance of the shaft beyond the push plate, such as in excess of the already noted 5 inch projection of the shaft.

Figure 10:
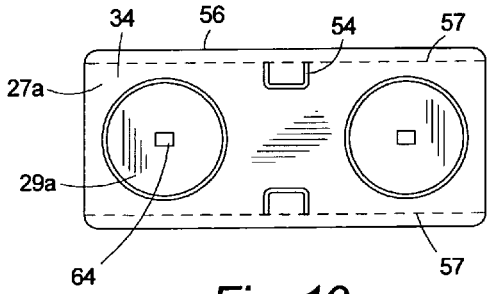

FIG. 10 illustrates a typical blank 27*a* of metal before the cage plate 27 is fully formed therefrom, having U-shaped slots 54 cut with the end portions of the slot legs inboard of the side edges 56 and terminating at the proposed fold line 57. In forming the side flanges 38, the side edges 56 are bent downward along lines 57 passing through the ends of the U-shaped slots 54, whereby the slot material connected to the edges 56 are forced upward to form upright tabs 40, leaving tab holes 59 at the sides of the horizontal wall 34. The tabs 48 and tab holes 60 in the shelf plate 28 are formed in a similar manner.

The upright tabs 40 and 48 may be used to hang user items, such as purses, bags, etc., from the holder 22 and to retain items, such as game equipment, pencils, etc., on the top surfaces of the plates 27 and 28. The tab holes 59 and 60 can be used to attach rings, cable ties and the like to mount scorecards, can openers, and other often used items. Formed into the shelf plate 28 are a pair of somewhat C-shaped openings 62 that are adapted to receive and bind against capped bottles positioned there against from the under side of the shelf plate 28, thereby serving as bottle openers.

The toe push 29 may be made from the scrap circular disks 29*a* left over when the cage plate holes 41 are cut as indicated in FIG. 10. Rectangular holes 64 formed in the center of the disks 29*a* correspond to the cross-sectional size of the shaft 26. After the formed toe push is removed from the cage plate sheet, the toe push 29 is slid onto the end of the shaft 26 and fixed in place, as by welding or the like. For added strength and rigidity, two or more circular pieces can be secured together to form a thicker toe push. The circular toe push plate allows a user to apply force from any direction, and with either foot, when forcing the shaft into the ground. As already noted, the toe push plate will limit the depth that the shaft can be set in the ground.

Figure 8:
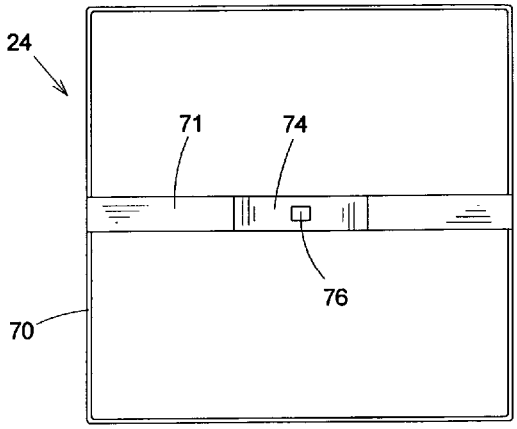
FIG. 8 is an enlarged top plan view of the base shown in FIGS. 1 and 3.

As seen in FIGS. 8 and 9, the base 24 has a support structure defined by a relatively thin strip of material set on end and formed into a four-sided rectangular frame 70, and by bridge 71 and brace 72 cross pieces rising thereabove. The bridge 71 extends angularly upward and inward from opposed sides of the frame 70 and converges to a horizontal flat deck 74 above the frame 70. The horizontal brace 72 extends between medial portions of the angled legs of the bridge 71 and is spaced downward from the deck 74. Formed in the center of the upper deck 74 and the lower brace 72 are vertically aligned rectangular holes 76 and 77, respectively, sized and shaped to receive the shaft 26 and hold it in a vertical upright position.

The height of the deck 74 above the bottom of the base 24 is greater than the distance between the shaft tip 32 and the toe push 29. As seen in FIG. 3, when the shaft 26 is fully inserted axially into the base 24 through the holes 76 and 77, the toe push 29 abuts the deck 74 with the pointed tip 32 of the shaft 26 being supported above the bottom of the frame 70 so that the surface on which the frame 70 is placed is not damaged by the pointed tip 32 of the shaft 26.

The stand 20 herein described preferably can be made of cold rolled steel sheets, strips, and bar stock, which when cut, formed, welded, and painted should provide a strong, long-lasting construction. However, other suitable materials may alternatively be employed.

INDUSTRIAL APPLICABILITY

It should be apparent the portable beverage holder described herein is simple and functional, but yet is effective and can be easily manufactured. However, it should be understood that the terms "top," "bottom," "first," "second," "upper," "lower," "height," "width," "length," "end," "side," "horizontal," "vertical," and possibly other similar terms used herein, have been utilized only to describe the invention, as referenced to the structure shown in the drawings and described in the specification, and should not be regarded as limitations.

While a specific embodiment of the invention has been disclosed, one of ordinary skill in the art will recognize that modifications can be made thereto without departing from the basic scope of the invention or the inventive concept. It is thus intended that this invention is to be limited only by the appended claims.

What is claimed is:

1. A portable stand for holding a beverage container above a supporting surface comprising:

an elongated shaft having a first end adapted for insertion into the supporting surface and a second end adapted to extend above the supporting surface with the shaft being vertically upright;

a substantially flat, relatively thin cage plate fixed to said shaft at said second end and extending laterally outward from opposite sides of said shaft;

said cage plate having a hole formed therein on each side of said shaft adapted to receive a container therein and each hole having a wall edge that surrounds a container positioned therein;

a substantially flat, relatively thin shelf plate secured to the shaft spaced below said cage plate, the shelf plate extending laterally outward from opposite sides of said shaft and under the cage openings, whereby the shelf plate supports the bottom of the container to limit downward movement and the walls of the cage plate holes limit lateral movement of the supported container; and, upright tabs formed adjacent the edges of the plates whereby objects placed on the plates are retained by the tabs and objects may be hung therefrom.

2. A portable stand for holding a beverage container above a supporting surface comprising:

an elongated shaft having a first end adapted for insertion into the supporting surface and a second end adapted to extend above the supporting surface with the shaft being vertically upright;

a substantially flat, relatively thin cage plate fixed to said shaft at said second end and extending laterally outward from opposite sides of said shaft;

said cage plate having a hole formed therein on each side of said shaft adapted to receive a container therein and each hole having a wall edge that surrounds a container positioned therein;

a substantially flat, relatively thin shelf plate secured to the shaft spaced below said cage plate, the shelf extending laterally outward from opposite sides of said shaft and under the cage openings, whereby the shelf plate supports the bottom of the container to limit downward movement and the walls of the cage plate holes limit lateral movement of the supported container; and, at least one of said plates having a tab and a tab opening formed adjacent its edge, said tab and tab opening being formed by cutting a generally U-shaped slot inboard of the plate edge with slot legs spaced from but closely adjacent the plate edge, folding the edge of the plate downward along a line passing through the ends of the slot legs so that the plate material between the slot legs is rotated upward as the plate is folded downward to form the tab and create a tab opening.

3. A portable stand for holding a beverage container above a supporting surface comprising:

an elongated shaft having a first end adapted for insertion into the supporting surface and a second end adapted to extend above the supporting surface with the shaft being vertically upright;

a substantially flat, relatively thin cage plate fixed to said shaft at said second end and extending laterally outward from opposite sides of said shaft;

said cage plate having a hole formed therein on each side of said shaft adapted to receive a container therein and each hole having a wall edge that surrounds a container positioned therein;

a substantially flat, relatively thin shelf plate secured to the shaft spaced below said cage plate, the shelf plate extending laterally outward from opposite sides of said shaft and under the cage openings, whereby the shelf plate supports the bottom of the container to limit downward movement and the walls of the cage plate holes limit lateral movement of the supported container; and, a separate base for holding said shaft vertically upright, the base including a rectangular frame with two pairs of opposed lower frame members adapted to rest on the supporting surface, a bridge extending between one pair of lower frame members and having legs fixed thereto, a brace extending between said bridge legs, said bridge and brace having axially aligned holes adapted to receive and hold said shaft upright therein.

4. The portable stand of claim 3 further including a toe push extending laterally outward from the shaft intermediate said shelf and shaft first end with said toe push being spaced from the shaft first end such that said toe push abuts said bridge and said shaft first end lies above the supporting surface when said shaft is inserted into the aligned bridge and brace holes.

5. A portable stand for holding a beverage container above a supporting surface comprising:

an elongated shaft having a first end adapted to be removably inserted into a supporting medium and a second end adapted to then be elevated above the supporting medium with the shaft being aligned vertically upright;

a substantially flat, relatively thin cage plate fixed to said shaft at said second end and extending laterally outward from opposite sides of said shaft;

said cage plate having holes formed therein spaced from the sides of shaft each adapted to receive a container therein, each hole having a internal wall that surrounds and laterally contains a container positioned therein;

a substantially flat, relatively thin shelf plate secured to the shaft spaced below said cage plate, the shelf plate extending laterally outward from opposite sides of said shaft and under the cage openings, whereby the shelf plate supports the bottom of the container to limit downward movement thereof and the walls of the cage plate holes limit lateral movement of a container;

a substantially flat, circular toe push fixed to said shaft intermediate said shaft first end and said shelf plate, said toe push extending radially outward from all sides of the shaft so that may be engaged from all sides by a user's foot to apply axial pressure to said shaft; and, a separate base defining one form of said optional supporting medium for holding said shaft vertically upright, the base including a rectangular frame with two pairs of opposed lower frame members adapted to rest on the supporting surface, a bridge extending between one pair of lower frame members and having legs fixed thereto, a brace extending between said bridge legs, said bridge and brace each having an axially aligned hole adapted to receive and hold said shaft upright therein, while the ground forms an alternative form of said optional supporting medium for holding said shaft vertically upright.

* * * * *